US010562697B2

(12) United States Patent
Ramsey

(10) Patent No.: US 10,562,697 B2
(45) Date of Patent: Feb. 18, 2020

(54) COMPACT AEROSOL CONTAINER

(71) Applicant: CROWN Packaging Technology, Inc., Alsip, IL (US)

(72) Inventor: Christopher Paul Ramsey, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 15/703,439

(22) Filed: Sep. 13, 2017

(65) Prior Publication Data

US 2018/0127195 A1 May 10, 2018

Related U.S. Application Data

(60) Provisional application No. 62/394,460, filed on Sep. 14, 2016.

(51) Int. Cl.

| | |
|---|---|
| ***B65D 83/20*** | (2006.01) |
| ***B65D 83/38*** | (2006.01) |
| ***B65D 83/44*** | (2006.01) |
| ***B65D 83/40*** | (2006.01) |

(52) U.S. Cl.

CPC ..... *B65D 83/207* (2013.01); *B65D 83/38* (2013.01); *B65D 83/40* (2013.01); *B65D 83/44* (2013.01)

(58) Field of Classification Search

CPC ..... B65D 83/207; B65D 83/38; B65D 83/44; B65D 83/48

See application file for complete search history.

(56) References Cited

U.S. PATENT DOCUMENTS

| | | | | |
|---|---|---|---|---|
| 2,626,834 | A | 1/1953 | North, Jr. | |
| 3,150,803 | A * | 9/1964 | Green | B65D 83/20 222/402.24 |
| 3,352,496 | A * | 11/1967 | Lipske | B65D 83/60 239/304 |
| 4,124,149 | A * | 11/1978 | Spitzer | B65D 83/44 222/402.18 |
| 4,141,472 | A * | 2/1979 | Spitzer | B65D 83/44 137/199 |
| 5,385,303 | A * | 1/1995 | Gosselin | B05B 1/1645 222/153.1 |
| 2004/0195374 | A1* | 10/2004 | Parsons | B05B 1/14 239/337 |
| 2010/0001020 | A1 | 1/2010 | Ashley | |
| 2010/0206891 | A1* | 8/2010 | Boltshauser | B21D 51/2653 220/658 |
| 2010/0300916 | A1* | 12/2010 | Alvares | B65D 21/0231 206/509 |
| 2016/0009482 | A1* | 1/2016 | Martz | F16K 31/58 137/605 |

FOREIGN PATENT DOCUMENTS

| | | | |
|---|---|---|---|
| EP | 0781712 | A1 | 7/1997 |
| WO | WO 01/89956 | A2 | 11/2001 |
| WO | WO 01/89956 | A3 | 11/2001 |
| WO | WO 02/24548 | A1 | 3/2002 |

* cited by examiner

*Primary Examiner* — Jeremy Carroll

(74) *Attorney, Agent, or Firm* — BakerHostetler

(57) ABSTRACT

An aerosol container includes a single piece or a two-piece mounting cup that is concave and, preferably, enables stacking and is lightweight.

14 Claims, 6 Drawing Sheets

Achieve 13.4 bar performance

COMPACT AEROSOL CONTAINER

TECHNICAL FIELD

The present inventions relates to containers, and more particularly for containers suitable of dispensing products through a valve, commonly referred to as aerosol containers.

BACKGROUND

Many household products are dispensed from pressurized containers through a dispensing valve, which containers are generally referred to as "aerosol containers." Conventional aerosol containers are usually pressurized by a volatile liquid propellant, which provides an adequate pressure for dispensing even after a portion of the product has been dispensed from the container.

When filling conventional aerosol products, a manufacturer fills a can with the product and promptly charges it with the volatile propellant. The filled can, in a ready-to-use form, is then shipped according to U.S. Department of Transportation rules. For example, container designs given a DOT-2Q designation must be rated to withstand 270 psi and container designs given a DOT-2P designation must be rated to withstand 240 psi.

Conventional aerosol containers may be configured such that, for example, the product and propellant are in contact, or the product is housed in a bag within the can while the propellant is housed outside the bag, or a piston separates the product from the propellant. An example of the latter is EarthSafe™ Dispensing Technology, marketed by Crown Cork and Seal.

A type of popular, conventional aerosol can structure is referred to as a three piece can, in which the parts are (i) a can "body" formed by rolling a flat sheet and welding the vertical seam, (ii) a "bottom" attached to the body by a seam, and (iii) an "end" seamed onto the top of the body. The end is dome-shaped. A flange for seaming to the can body is formed at the bottom of the aerosol end. A curl for receiving a valve is formed at the top of the aerosol end. Prior art aerosol cans include steel ends on steel bodies, aluminum ends on aluminum bodies, and aluminum ends on steel bodies.

Another conventional aerosol can includes an integral bottom and body formed in a process referred to as impact extrusion, such as sold by Exal Corporation. The impact extrusion process rams a slug of aluminum into the can body shape. Impact extrusion forms a relatively thick base. Shaped cans are also in the marketplace. Also, some aerosol containers have an integral can bottom and sidewall, as the body is formed by drawing and ironing.

Regardless of the structure of the can body, a dome on an aerosol can is ubiquitous in commercial aerosol containers. As illustrated in FIG. 1, a typical prior art container 110 includes a can body 112 that is seamed onto a dome 114. A valve cup 116 is crimped into the dome 114 by the filler at curl 124. The product is filled either before fitting the cup or through the valve 118. The mass of the top component (that is, the dome) and valve cup is large because of the raised structure and need for the crimp to form a gas tight seal at pressures of up to 18 bar pressure. Sidewall 112 and dome 114 are connected at seam 120. As illustrated in FIG. 1, the upper end of the stem 128 of valve 118, the upper end of the body 132, and the upper end of the ferrule 126 are above the uppermost point of the seam 120. FIG. 2 illustrates container 110 without valve cup 116 and valve 118.

SUMMARY

It has been a longstanding goal to reduce material usage in aerosol containers while maintaining good sealing properties over the mass manufacture of commercial quantities of containers. It was proposed that a single, convex top component replace the conventional two-piece dome that is shown in FIG. 1. The inventors have identified a problem with integrating the two piece convex top with a single, unitary top piece. In this regard, the preferred assembly procedure is for the can maker to assemble the valve into the unitary top piece before seaming onto the can. Thus, it is preferred that the can supplied is stackable.

An aerosol can is provided such that the top component has a concave rather than convex profile. A female valve type is preferred so that the stem does not protrude above the seam.

The portion of this provisional application entitled "Claims" is incorporated here.

DETAILED DESCRIPTION OF ILLUSTRATIVE EMBODIMENTS

Figure 1:
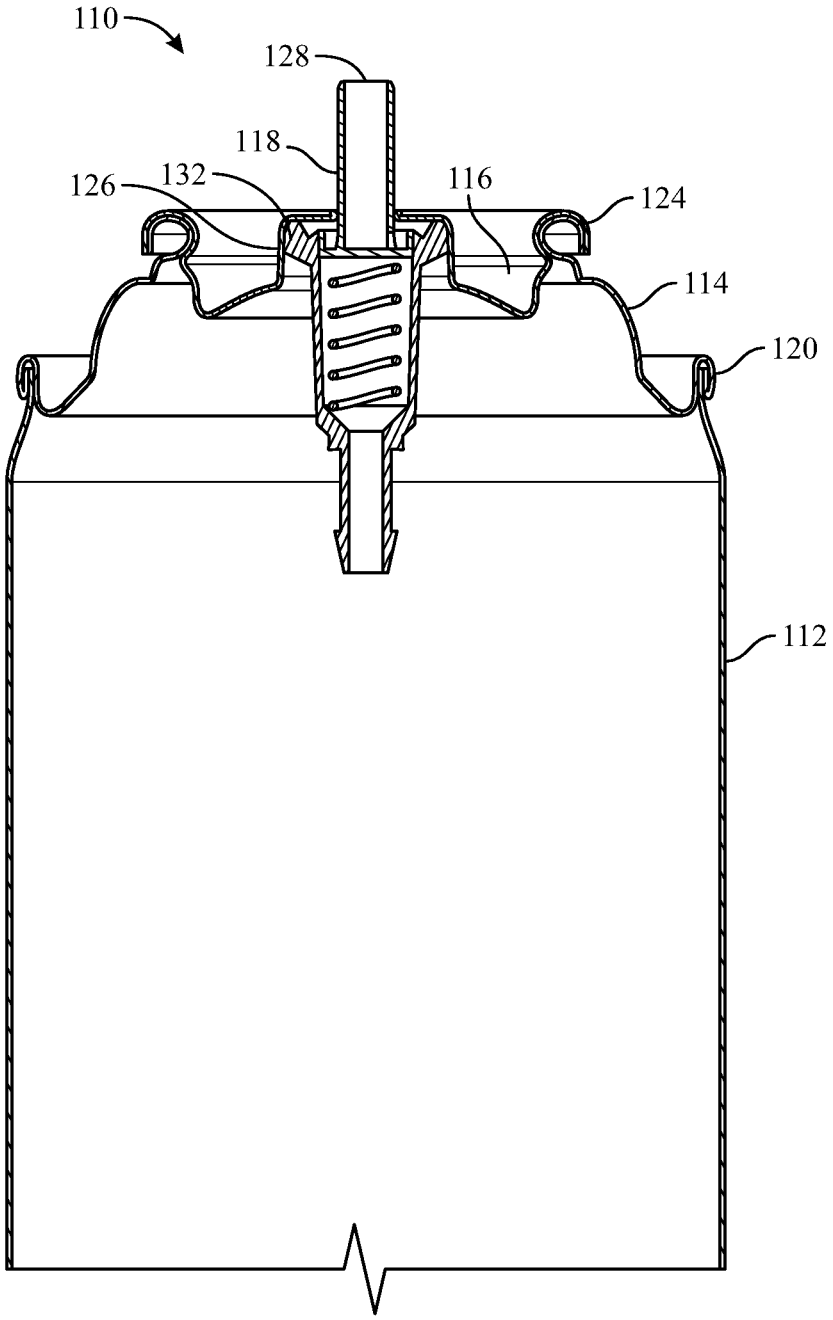
FIG. 1 (Prior Art)
FIG. 1 (Prior Art) is a cross sectional view of a conventional aerosol package.
Figure 2:
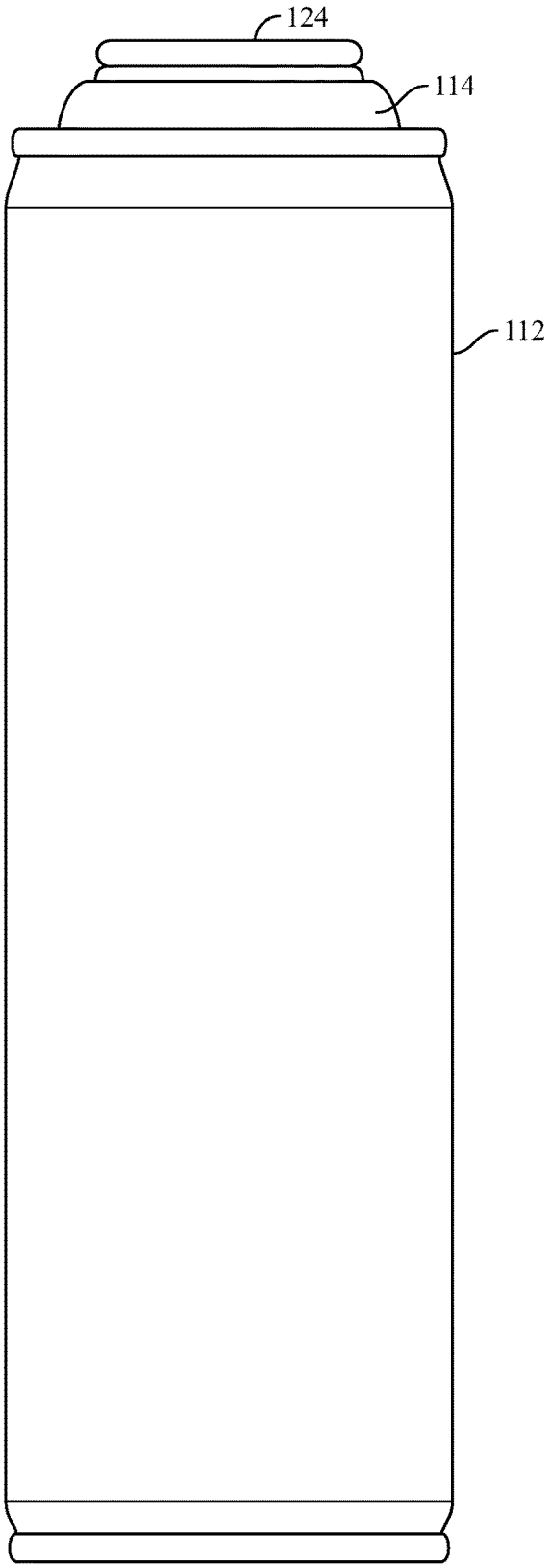
FIG. 2 (Prior Art)
FIG. 2 is a side view of the prior art package of FIG. 1, with valve cup and valve removed.

As illustrated in FIGS. 3 through 6, an aerosol container 10 includes a body, which in the figures is illustrated by a sidewall 12 and a seamed on base 14. Alternatively, the base and sidewall can be integral (not shown), such as in an impact extrusion, drawn and ironed body, or the like. Sidewall 12 has a neck 16 that is a reduced diameter portion of the sidewall. Preferably, the outside diameter of the neck at the seam 22 is at least 75% of the outside diameter of the sidewall 12, preferably at least 80%, more preferably at least 85%.

Figure 4:
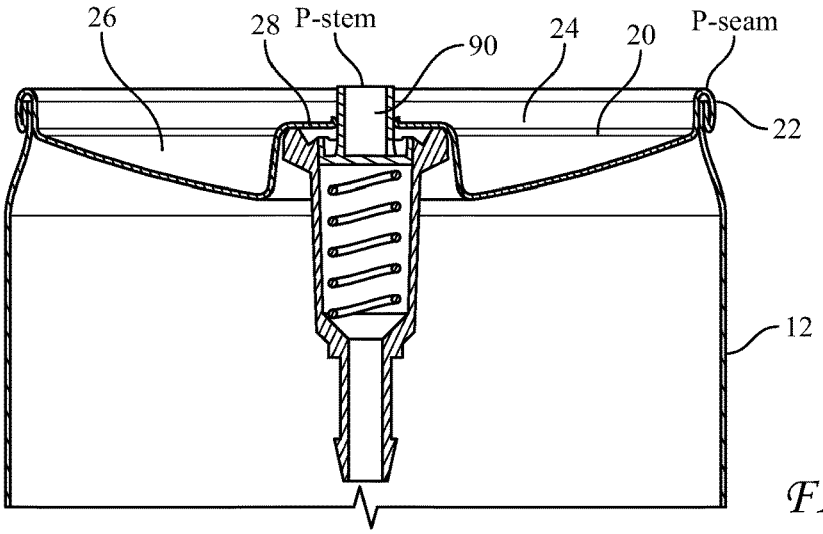
FIG. 4 is a cross sectional view of a portion of the embodiment of FIG. 3.
Figure 5:
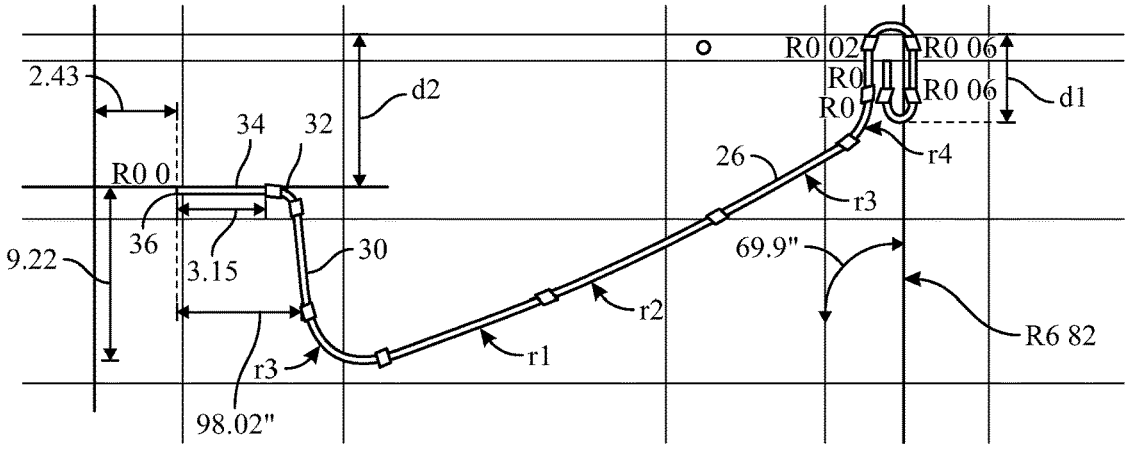
FIG. 5 is a cross sectional view of a portion of a mounting cup that is a portion of the embodiment of FIG. 1.
Figure 5:
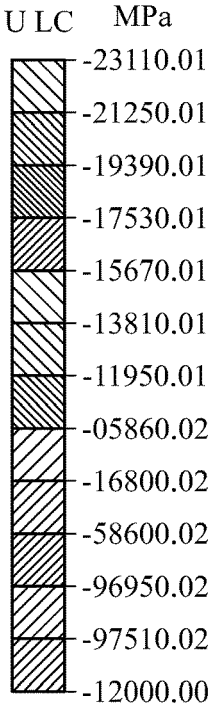
Figure 5:
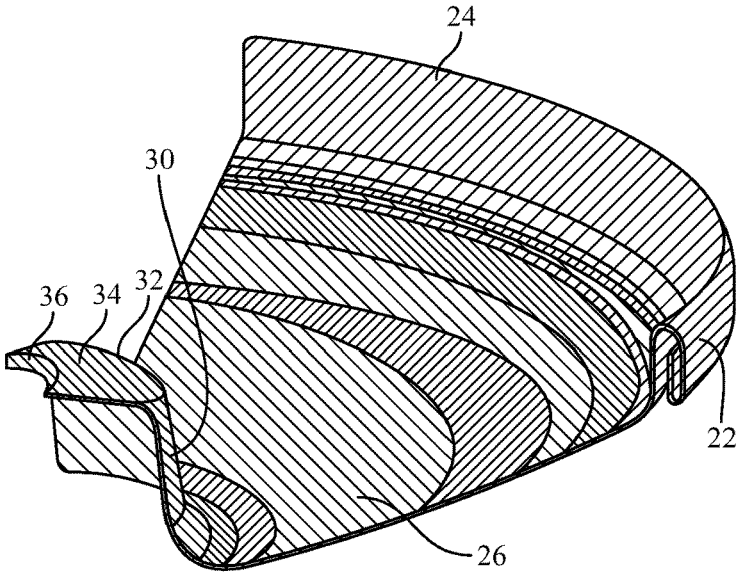
Figure 6A:
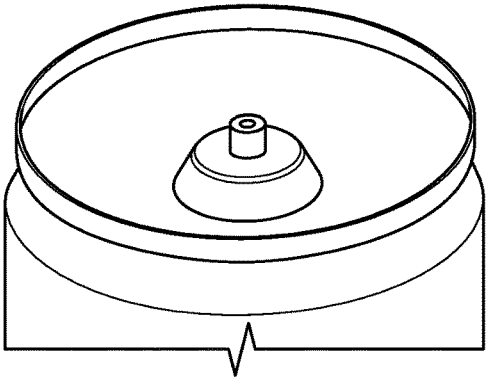
FIG. 6 is a side by side perspective view of the embodiment of FIG. 1 next to a prior art embodiment.
Figure 6B:
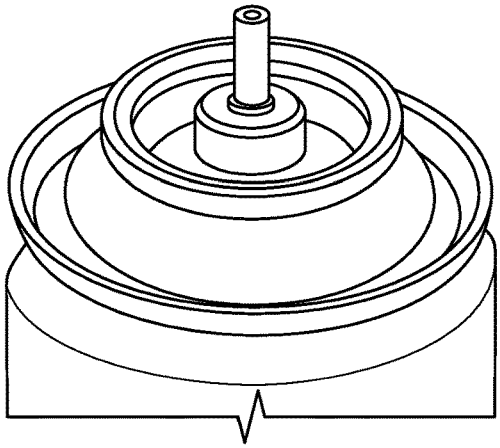

Container 10 also includes a mounting cup 20 and a valve 90 that is mounted into mounting cup 20. Cup 20 is coupled to sidewall 12 at seam 22. Preferably, seam 22 is a conventional seam, sometimes referred to as a double seam. As best shown in FIGS. 4 and 5, cup 20 includes an inner seam wall 24 that merges into a downwardly oriented dish portion 26 at radius r4. In other words, disk portion 26 extends downwardly from seam 22. Dish portion 26 is formed by radii r1, r2, and r3, each of which has a center that it outside the container or above the cup, as shown in the figures. A ferrule 28 includes an upstanding wall 30 that extends generally upwardly, and slightly angled inwardly, from an inner end of dish portion 26 at radius r5. Wall terminates 30 makes a bend at shoulder 32 to a generally horizontal, inwardly extending panel 34, which terminates at an upwardly extending neck 36. Preferably, wall 30 is angled to form an angle of about 98 degrees with the horizontal. Other dimensions are provided in the table below, as well as in FIG. 5:

| Optimised parameters | |
|---|---|
| d1 | 3.421516 |
| d2 | 4.763429 |
| r1 | 63.92925 |
| r2 | 68.92486 |
| r3 | 61.09736 |
| r4 | 0.676908 |
| r5 | 1.891776 |
| Thickness | 0.288732 |

Figure 3:
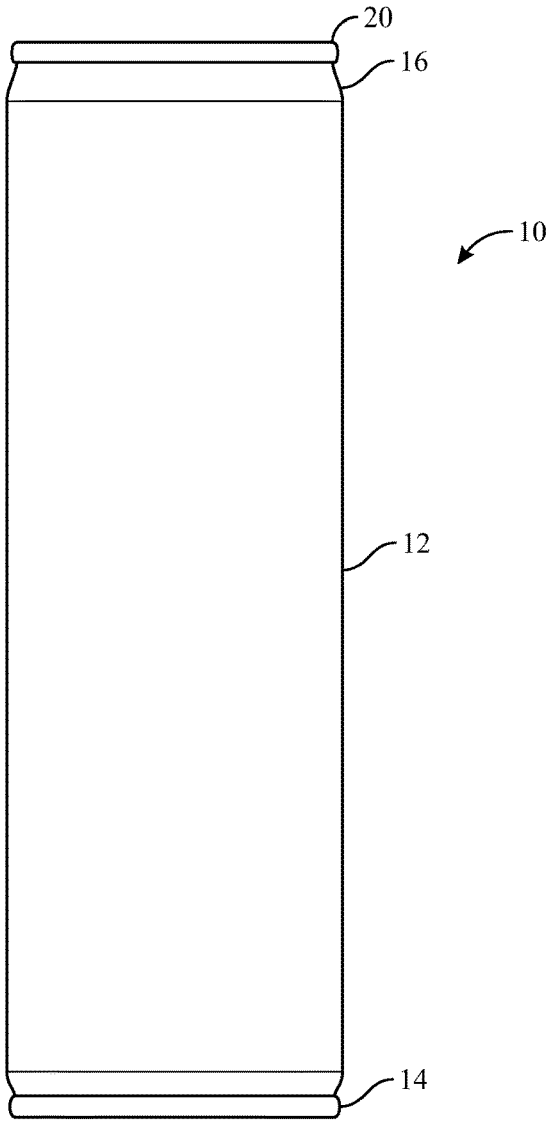
FIG. 3 is a side view of an aerosol package illustrating a first embodiment of the present invention.

Thus, mounting cup 20 is a single, unitary piece that extends from the seam 22 with the container sidewall 12 to the ferrule 28 to which valve 90 is attached. Preferably, the dimensions are as shown such that the uppermost point (that is, the extent) P-stem of the stem of valve 90 is no higher than or below the uppermost point (that, is extent) of the seam 22 at P-seam (FIG. 3). And upper panel 34 of ferrule 28 is also below the point P-seam.

Figure 7:
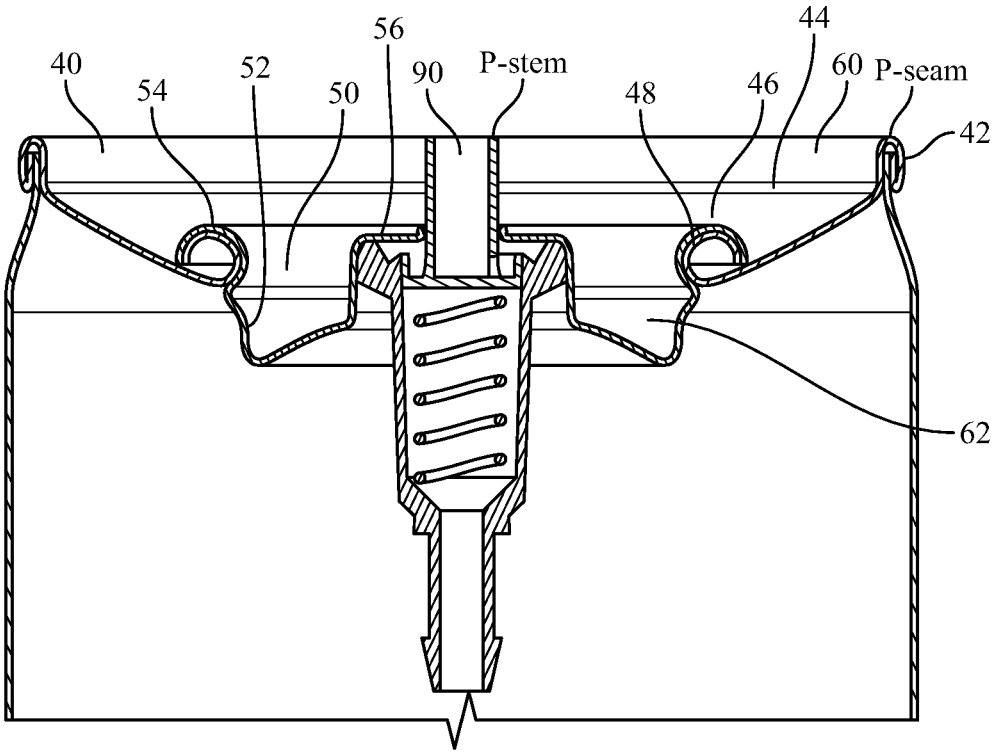
FIG. 7 is a cross sectional view of a portion of the another embodiment.

FIG. 7 illustrates a second embodiment mounting cup 40 that includes a ring-like, concave outer part 60 and an inner part 62. Outer part 60 includes a seam 42 that is connected to the can sidewall, and downwardly extending inner wall 44, a downwardly extending dish portion 46 that terminates in a curl 48. Inner part 62 includes a curl 54 that mates to curl 48, a downwardly depending inner sidewall 52, an upwardly extending panel wall 50, and a ferrule 56.

Curl 54 is crimped onto curl 48, preferably according to structure and methods that are conventional, as understood by persons familiar with aerosol can technology. Accordingly, inner sidewall 52 preferably is configured for the purpose of the crimp. Panel wall 50, in the embodiment illustrated has a center of its radius or radii located within the can or below cup 40. Preferably, ferrule 56 is as described for first embodiment ferrule 28.

Preferably, the dimensions of cup 40 are such that the uppermost point (that is, the extent) P-stem of the stem of valve 90 is no higher than or below the uppermost point (that, is extent) of the seam 42 at P-seam (FIG. 3). And the upper panel of ferrule 56 is also below the point P-seam.

Figure 8A:
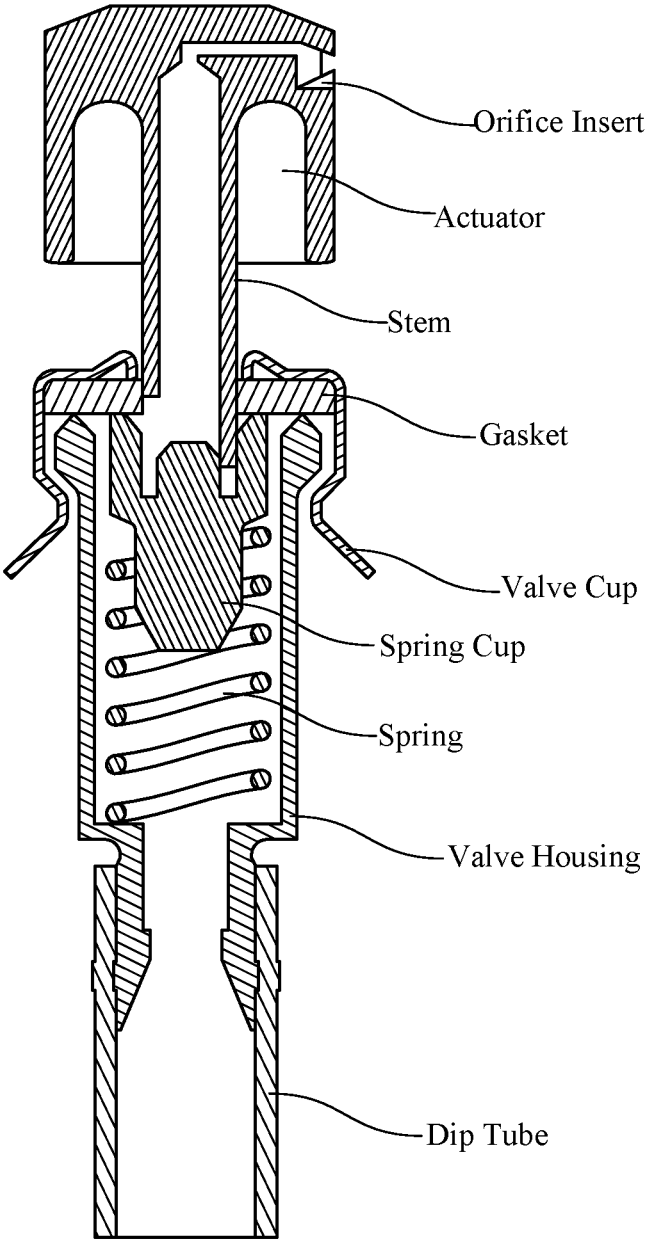
FIG. 8 is a schematic view of conventional valve technology and terminology that may be employed with the embodiments illustrated herein.
Figure 8B:
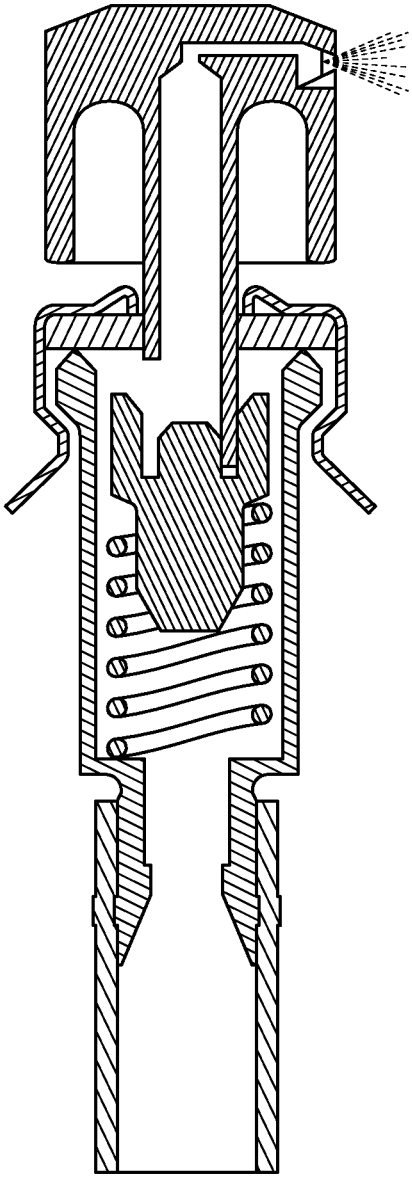

Preferably, valve 90 is a conventional, female valve that is well understood by persons familiar with aerosol can technology. FIG. 8 illustrates conventional valve terminology and structure. Thus, valve 90 can be preassembled with the valve cup and installed on the can as one piece or two piece by the can manufacturer, prior to pressure-filling or prior to shipping from the can manufacturer. The actuator can be added later. Preferably, the ferrule is formed by drawing metal over a boss. The valve is crimped under the ferrule, so that it is internal to the container.

Referring to the first embodiment of FIG. 3, finite element analysis on cup 20 demonstrates adequate pressure performance of 12 bar for temper 3 tinplate of 0.29 mm thickness, which the inventors surmise in some cases is a savings of approximately 50% by weight compared to conventional top & cup. The inventors calculate that the second embodiment cup 40 of FIG. 7 has a weight savings of approximately 22 percent, uses existing assembly routes, uses a standard one inch opening at the crimp, uses existing assembly routes that enable fillers to fill and crimp using existing methods and equipment.

Some concave aerosol can tops existed in the mid 1900s. The top components on these prior art cans were effectively can bottoms with holes in the centre and the valve attached externally, for example by soldering or by a separate mechanical fitting, rather than internal to the ferrule as illustrated in the figures.

The present invention is illustrated by employing embodiments and dimensions disclosed herein. The invention is not limited to the particular dimensions, however, but rather is entitled to the full extent of the claims, as allowed.

What is claimed:

1. An aerosol container comprising:

a can body having an enclosed base and a sidewall;

a mounting cup that is attached to the can body by a double seam at an upper end of the can body, the mounting cup including a dish portion and an upstanding ferrule, the dish portion being outwardly concave and extending continuously downward from the seam to the ferrule; and a valve that is attached to the mounting cup within the ferrule.

2. The aerosol container of claim 1 wherein the dish portion is a single piece and the upstanding ferrule extends upwardly from the dish portion and supports the valve.

3. The aerosol container of claim 1 wherein the ferrule contacts the valve.

4. The aerosol container of claim 1 wherein an uppermost point on the ferrule is no higher than an uppermost point on the seam.

5. The aerosol container of claim 1 wherein the valve includes a stem and wherein an uppermost point on the stem is no higher than an uppermost point on the seam.

6. The aerosol container of claim 1 wherein the can base and can sidewall are integral as formed by either drawing and ironing or impact extrusion.

7. The aerosol container of claim 1 wherein the can sidewall is a tube that is attached to the can body by a seam.

8. The aerosol container of claim 1 wherein the valve is a female valve.

9. The aerosol container of claim 1 wherein the container is stackable on a second container, wherein the second container includes a second can body having an enclosed base and a sidewall; a second mounting cup that is attached to the second can body by a seam at an upper end of the second can body, the second mounting cup being outwardly concave and including an upstanding ferrule; and a valve that is attached to the second mounting cup within the ferrule.

10. The aerosol container of claim 1 wherein the upper end of the can body includes a neck at the seam, and wherein an outside diameter of the neck at the seam is at least 75% of an outside diameter of the sidewall.

11. The aerosol container of claim 1 wherein the ferrule comprises an upstanding wall that extends from the dish portion at an inward angle.

12. The aerosol container of claim 1 wherein the mounting cup is a single unitary piece.

13. An aerosol container comprising:

a can body having an enclosed base and a sidewall;

a mounting cup that is attached to the can body by a seam at an upper end of the can body, the mounting cup including a ring-like, concave outer part and an inner part that is crimped to the outer part, the outer part being outwardly concave and extending continuously downward from the seam to the inner part, the inner part including an upstanding ferrule; and a valve that is attached to the mounting cup within the ferrule.

14. The aerosol container of claim 13 wherein an uppermost point on the ferrule is no higher than an uppermost point on the seam.

* * * * *